US008595921B2

(12) United States Patent
Ellis et al.

(10) Patent No.: US 8,595,921 B2
(45) Date of Patent: Dec. 3, 2013

(54) ELECTRODES MADE USING SURFACING TECHNIQUE AND METHOD OF MANUFACTURING THE SAME

(75) Inventors: Timothy W. Ellis, Dallas, TX (US); Matthew Burr, Irving, TX (US)

(73) Assignee: RSR Technologies, Inc., Dallas, TX (US)

( * ) Notice: Subject to any disclaimer, the term of this patent is extended or adjusted under 35 U.S.C. 154(b) by 144 days.

(21) Appl. No.: 12/948,560

(22) Filed: Nov. 17, 2010

(65) Prior Publication Data

US 2012/0118758 A1 May 17, 2012

(51) Int. Cl.
*B23P 19/04* (2006.01)

(52) U.S. Cl.
USPC ..... 29/746; 204/291; 204/290.01; 204/280; 205/205; 205/206; 205/208; 205/210; 205/212; 205/213; 205/214; 205/217; 205/219

(58) Field of Classification Search
USPC ..... 204/280, 290.01, 291; 205/205, 206, 205/208, 210, 212, 213, 214, 217, 219; 29/746
See application file for complete search history.

(56) References Cited

U.S. PATENT DOCUMENTS

| | | | | |
|---|---|---|---|---|
| 4,688,015 | A * | 8/1987 | Kojima et al. | 338/34 |
| 4,742,650 | A | 5/1988 | Sauder, Jr. et al. | |
| 4,864,775 | A | 9/1989 | David | |
| 5,099,615 | A | 3/1992 | Ruble et al. | |
| 5,172,850 | A | 12/1992 | Prengaman et al. | |
| 5,314,601 | A * | 5/1994 | Hardee et al. | 204/290.03 |
| 5,938,508 | A | 8/1999 | Canella et al. | |
| 6,070,444 | A * | 6/2000 | Lontine et al. | 72/46 |
| 6,406,355 | B1 * | 6/2002 | Keeler | 451/28 |
| 2003/0139049 | A1 | 7/2003 | Nakamura et al. | |
| 2006/0193106 | A1 * | 8/2006 | Kobayashi et al. | 361/540 |
| 2006/0198083 | A1 * | 9/2006 | Kobayashi et al. | 361/540 |

FOREIGN PATENT DOCUMENTS

| | | |
|---|---|---|
| WO | WO-00/39366 A1 | 7/2000 |

OTHER PUBLICATIONS

International Search Report and Written Opinion of the International Searching Authority (European Patent Office) for International Patent Application No. PCT/US2011/060890, mailed May 18, 2012.
Informal Comments filed with the International Bureau of WIPO in reply to the International Search Report and Written Opinion of the International Searching Authority (European Patent Office) for International Patent Application No. PCT/US2011/060890, mailed Aug. 24, 2012.

* cited by examiner

*Primary Examiner* — Bruce Bell
(74) *Attorney, Agent, or Firm* — K&L Gates LLP

(57) ABSTRACT

An electrode is formed using a sanding mechanism to condition the surface of the electrode for electrochemical purposes. Hazardous particles emitted during sanding are captured using jetted liquid, and may be recycled for later use. The sanded surface provides increased electrode lifespan and lead oxide adherence.

20 Claims, 1 Drawing Sheet

ELECTRODES MADE USING SURFACING TECHNIQUE AND METHOD OF MANUFACTURING THE SAME

FIELD OF THE INVENTION

In general, the present invention relates to electrodes used in electrochemical processes, and more specifically, to surfacing processes for such electrodes which decrease conditioning time, as well as improving environmental safety and increasing electrode life span.

BACKGROUND OF THE INVENTION

According to conventional practice, the surfaces of electrodes used in alchemical cells are prepared using abrasive media blasting, such as sandblasting. Sandblasting employs high pressure air and particulate abrasive matter to cut the surface of the target electrode. There are a number of disadvantages associated with conventional sandblasting processes as discussed below.

Conventional sandblasting processes involve a high degree of risk to the worker. Generally, Silica sand is utilized as the abrasive material for electrochemical reasons. Silica dust, however, presents health hazards and environmental concerns. Other materials, such as steel shot, slag, and walnut shells, tend to produce inferior electrode surfaces and, like Silica, have limited life spans. When these materials are utilized as the abrasive material, they are exposed to one of the following phenomena or a combination of both: First, the cutting surfaces of the material may fracture, thereby reducing the effectiveness of the cut. Second, the material may pick up a coating of lead during the blasting process which, in turn, blunts the cutting surfaces of the material, thereby reducing the effectiveness of the cut. In turn, both phenomena reduce the usability (i.e., lifespan) of the abrasive material. In addition, the particulates emitted into the atmosphere during sandblasting are also hazardous, thereby further endangering workers.

Conventional sandblasting also produces spent materials which require costly disposal operations. Once the abrasive material has met the end of its life span, it must be safely disposed. Due to the level of lead and silica contamination produced during sandblasting, the spent material is non-recyclable and must either be disposed of as hazardous waste or exposed to further processing to remove the hazardous materials—both of which are costly. In addition, workers involved in transporting the materials are further exposed to hazardous material.

In addition, the U.S. Environmental Protection Agency (E.P.A.) has lowered the ambient air lead standard to 0.15 $\mu g/m^3$ from 1.2 $\mu g/m^3$. Conventional sandblasting operations cannot readily meet this standard. Currently, sandblasting is done in rooms with large doors for ease of loading. As the material is blasted, it is propelled throughout the room. Air systems are employed to capture much of this material and filter it out, but inevitably some material avoids capture. The escaped material settles out and needs to be vacuumed up before it gets reintroduced to the air, or transported outside of the blasting room. The addition of a negative pressure system can help to reduce this problem, but not eliminate it. Additionally, the blast media eventually must be disposed; however, it is contaminated with lead, thereby requiring disposal as a hazardous waste which adds further cost to the operation.

The abrasive grit itself also gives rise to concern. During sandblasting, the grit can become embedded in the lead electrode sheets. Once embedded, the grit can interfere with the customer's tank house chemistry, possibly affected the end product.

Conventional sandblasting also requires a costly skilled workforce. If the workers are not sufficiently skilled, sandblasting can result in uneven surface finishes, thinning, or even warping of the electrodes. Even given sufficiently skilled workers, these problems may still arise due to human error.

Once the electrodes have been produced using conventional sandblasting, their usefulness is also limited. In electrowinning tanks, for example, when the lead anode is submerged in the tank liquor, the chemical reaction results in a layer of lead oxide forming on the surface of the anode, which helps to protect the anode from corrosion. Due to the characteristics of the surface produced by sandblasting, the protective lead oxide layer has difficulty adhering to the anode surface and takes some time to form, thereby allowing corrosion to begin and significantly reducing the life span of the anode. In addition, since the lead oxide layer has difficulty adhering to the anode, some particles fall to the bottom of the tank housing. Over time, this results in a high amount of sludge forming at the bottom of the tank, which calls for costly periodic cleanings.

In view of the foregoing, there is a need in the art for an electrode surfacing process which removes the need for a skilled labor workforce and the associated high probability of defective electrodes, and reduces environmental hazards and worker safety concerns, and the costs associated therewith. There is also a need in the art for an electrode surfacing process which meets new E.P.A. standards. In addition, there is a need in the art for an electrode having improved surface adherence capability, thereby resulting in a more cost efficient and useful electrode.

SUMMARY OF THE INVENTION

The present invention provides exemplary electrodes for use in electrochemical processes and methods of manufacturing the same. In an exemplary methodology, an electrode sheet is conveyed into a sanding mechanism whereby a surface of the electrode is sanded. During sanding, hazardous particles which are emitted are captured using liquid jetted into the region surrounding the hazardous particles. In this exemplary methodology, less than 1.2 $\mu g/m^3$ of lead is allowed to pass into the atmosphere. The liquid/particle mixture can then be recycled for further use. Electrochemical electrodes produced using this process have increased life spans and increased lead oxide adherence as compared to prior art electrodes.

DETAILED DESCRIPTION OF THE INVENTION

Illustrative embodiments and methodologies of the present invention are described below as they might be employed in the manufacture of electrodes as described herein. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the present invention will become apparent from consideration of the following description and drawings.

Figure 1:
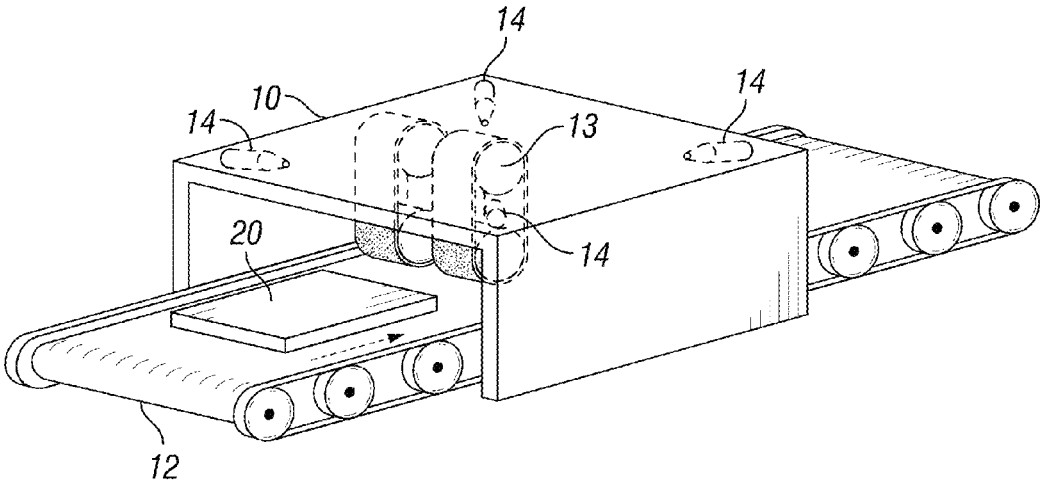
FIG. 1 illustrates an electrode undergoing a sanding process according to an exemplary methodology of the present invention.

FIG. 1 illustrates a sanding machine 10 which may be utilized in an exemplary methodology of the present invention. Sanding machine 10 may be, for example, a Timesavers® Series PUMA metal sander manufactured by Timesavers, Inc. of Maple Grove, Minn., the operation of which is well known in the art. An electrode sheet 20, such as anode, is transported to sanding machine 10 in order to begin surface preparation. An exemplary anode can be those as disclosed in U.S. Pat. Nos. 5,172,850 and 6,131,798, both of which are hereby incorporated by reference in their entirety. In this exemplary methodology, electrode 10 is transported to sanding machine 10 using a vacuum lift (not shown) to protect both the flatness and surface of electrode 10. However, those ordinarily skilled in the art having the benefit of this disclosure realize other means of transportation may be utilized. In addition, those ordinarily skilled in the art having the benefit of this disclosure realize the present invention may also be applied to manufacture cathodes.

After electrode 20 has been transported to sanding machine 10, it is put on conveyor belt 12. Conveyor belt 12 is used to convey electrode 20 into and out of sanding machine 10. Once placed on conveyor belt 12, electrode 20 begins moving into the sanding region of sanding machine 10. In this exemplary embodiment, sanding machine 10 has a two-headed sander having belts with a 36 grit rating. During testing of the present invention, it was discovered that a 36 grit belt, moving at a belt speed of 5-10 ft/min, having a 65-70 head load percentage, resulted in the most consistent surface finish which, in turns, results in a more adherent electrode (as understood in the art, head load percentage is the amount of current the motor is drawing compared to the maximum amount of current it is rated to). However, those ordinarily skilled in the art having the benefit of this disclosure realize other parameters may be utilized dependent upon job specifications.

Conveyor belt 12 continues to convey electrode 20 through sanding machine 10. As this is done, the entire surface of electrode 20 is sanded. At the same time, a series of jets 14 inject liquid, such as water, out into the sanding region (i.e., the junction whereby the surface of electrode 20 and the sanding heads meet). One purpose of the pressured liquid is to contain the particulate matter, such as lead or silica, being emitted due to the interaction of the sanding heads and electrode surface. In addition, as the liquid is emitted into the sanding region, it collects the particulate matter. Thereafter, this particulate/liquid mixture can be directed to some other mechanism or station and recycled for further use, as would be understood by one ordinarily skilled in the art having the benefit of this disclosure.

During testing, air samples were collected from the exit side of the sanding machine over an 8 hour period. The measured ambient lead levels were 7.38 $\mu g/m^3$, which is well within the current OSHA specified permissible exposure limit ("PEL") of 50 $\mu g/m^3$ over an 8 hour period. In addition, since the jetted liquid reduces the emitted particulates, the amount of hazardous particulates which need to be filtered before the emission leaves the factory is greatly reduced; therefore, the manufacturing facility requires less engineering associated with the filtering process. As a result, the manufacturing facility utilizing the present invention can readily meet the new E.P.A. ambient air lead standard of 0.15 $\mu g/m^3$.

In this exemplary methodology, sanding machine 10 is a single-surface sander. Therefore, once electrode 20 has been run through sanding machine 10 once, it is flipped and reconveyed through sanding machine 10, whereby the opposing surface is also sanded. A flip table or some other means may be utilized to flip electrode 20. However, in the alternative, a double-sided sanding machine may be utilized, thereby negating the need for a flipping mechanism. Now that both surfaces of electrode 20 have been sanded, it is ready for further use, such as in an electrowinning process or some other use.

Figure 2:
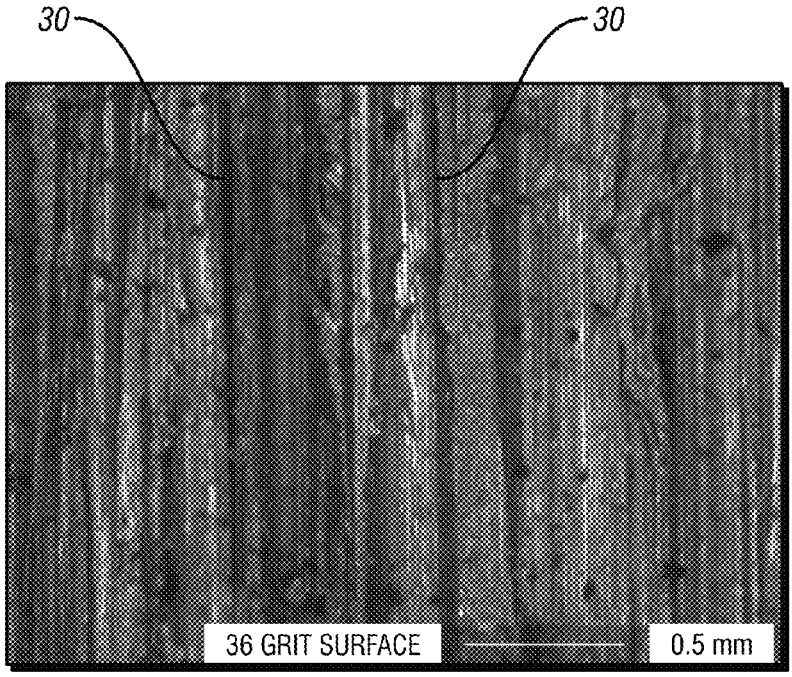
FIG. 2 illustrates an exploded view of the surface of an electrode manufactured using a sanding process according to an exemplary methodology of the present invention.

FIG. 2 illustrates an enhanced view of the surface of electrode 20 created using an exemplary methodology of the present invention. As a result of the sanding process, grooves 30 are formed along the surface of electrode 20. In the electrowinning context, it has been discovered, through testing, that the geometry of grooves 30 provide increased lead oxide adherence, which enable the lead oxide layer to form more rapidly. As such, the corrosive effects of the chemical bath are severely limited and, in turn, the life span of the electrode is increased.

The chart below provides testing data comparing conventional sandblasting surface treatment and the sanding process of the present invention. In electrowinning, for example, when the electrode is submersed in a chemical bath, acid reacts with the surface of the electrode (e.g., an anode) in the presence of a current and a lead oxide layer is formed. As this layer grows, bits of lead oxide begin to fall off and form the "mud" on the bottom of the tank. As the material falls, it exposes new material to the acid and the process continues, resulting in corrosion. However, through utilization of the current inventive surfacing process, the lead oxide layer is more adherent and, thus, does not fall off and expose further new material, thereby stalling the corrosive process and increasing the life of the electrode. As shown in the chart below, the mud and scale formation rate is lower when utilizing the sanding process of the present invention as compared to sandblasting and no surface treatment whatsoever:

| Surface | Total Mud & Scale Formation Rate (g/kA h) | |
|---|---|---|
| Treatment | PbAg | PbCaAg |
| Prior Art Sand blasting | 5 | 9 |
| Sanding Process using 36-Grit belt | 3 | 8 |
| No surface treatment | 26 | 33 |

Accordingly, the present invention provides advantages over prior art electrodes and their respective sandblasting manufacturing processes. Through use of the sanding machine, employee's exposure to harmful particulates is greatly reduced. Also, the present inventive methodology provides an electrode manufacturing process which meets the OSHA PEL and new E.P.A. ambient lead air standards without requiring costly retrofitting of existing manufacturing facilities. The sanding process of the present invention also reduces the need for a skilled workforce and provides consistent surface finishes. Also, there is no ingrained abrasive matter in the electrode surface. Moreover, the resulting oxide layer is more adherent to the anode which, in turns, extends the life of the electrode.

An exemplary methodology of the present invention provides a method of making an electrochemical electrode, the method comprising the steps of (a) providing an electrode sheet; (b) sanding a surface of the electrode sheet using a sanding mechanism; (c) emitting a hazardous particulate matter in response to the sanding; (d) injecting liquid into a region whereby the sanding mechanism and the surface of the electrode come into contact; and (e) containing at least a portion of the hazardous particulate matter using the liquid. In an alternative methodology, the hazardous particulate matter comprises lead, the method further comprising the step of emitting less than 1.2 $\mu g/m^3$ of lead into a surrounding atmosphere. In yet another, step (b) comprises the steps of: moving the electrode sheet into the sanding mechanism using a conveyor belt, the conveyor moving at 5-10 feet per minute; and applying a sanding head to the surface of the electrode sheet, the sanding head having a 36 grit rating. In yet another exemplary methodology, the method further comprises the step of applying a 65-70 head load percentage to the sanding head. In another, the electrochemical electrode is an anode for use in electrowinning.

Another exemplary methodology of the present invention provides a method of making an electrochemical electrode, the method comprising the steps of (a) providing an electrode sheet; and (b) sanding a surface of the electrode sheet using a sanding mechanism. In yet another methodology, the method further comprises the steps of: emitting a hazardous particulate matter in a surrounding atmosphere; injecting liquid into a region of the hazardous particulate matter; and containing at least a portion of the hazardous particulate. In another methodology, the hazardous particulate matter comprises lead, the method further comprising the step of emitting less than 1.2 $\mu g/m^3$ of lead into the surrounding atmosphere. In yet another methodology, the electrochemical electrode is an anode.

An exemplary embodiment of the present invention provides an electrochemical electrode comprising an electrode sheet having a sanded surface. In an alternative embodiment, the electrochemical electrode is an anode for use in electrowinning.

Another exemplary embodiment of the present invention provides an electrochemical electrode comprising an electrode sheet having a sanded surface, wherein the electrode is manufactured using a method comprising the steps of (a) providing the electrode sheet; (b) sanding a surface of the electrode sheet using a sanding mechanism; (c) emitting a hazardous particulate matter in response to the sanding; (d) injecting liquid into a region whereby the sanding mechanism and the surface of the electrode come into contact; and (e) containing at least a portion of the hazardous particulate matter using the liquid.

While the invention is susceptible to various modifications and alternative forms, specific embodiments and methodologies have been shown by way of example in the drawings and has been described in detail herein. However, it should be understood that the invention is not intended to be limited to the particular forms or methodologies disclosed. As such, the intention is to cover all modifications, equivalents, and alternatives falling within the spirit and scope of the invention as defined by the appended claims.

What is claimed is:

1. A method of manufacturing an electrochemical electrode, the method comprising the steps of:

(a) providing an electrode sheet;

(b) sanding a surface of the electrode sheet using a sanding mechanism;

(c) emitting a hazardous particulate matter in response to the sanding;

(d) injecting liquid into a region whereby the sanding mechanism and the surface of the electrode come into contact; and (e) containing at least a portion of the hazardous particulate matter using the liquid.

2. A method as defined in claim 1, wherein the hazardous particulate matter comprises lead, the method further comprising the step of emitting less than 1.2 $\mu g/m^3$ of lead into a surrounding atmosphere.

3. A method as defined in claim 1, wherein step (b) comprises the steps of:

moving the electrode sheet into the sanding mechanism using a conveyor belt, the conveyor moving at 5-10 feet per minute; and applying a sanding head to the surface of the electrode sheet, the sanding head having a 36 grit rating.

4. A method as defined in claim 3, the method further comprising the step of applying a 65-70 head load percentage to the sanding head.

5. A method as defined in claim 1, wherein the electrochemical electrode is an anode for use in electrowinning.

6. A method of making an electrochemical electrode, the method comprising the steps of:

(a) providing an electrode sheet comprising lead; and (b) sanding a surface of the electrode sheet using a sanding mechanism comprising a sanding belt.

7. A method as defined in claim 6, the method further comprising the steps of:

emitting a hazardous particulate matter in a surrounding atmosphere;

injecting liquid into a region of the hazardous particulate matter;

and containing at least a portion of the hazardous particulate.

8. A method as defined in claim 7, wherein the hazardous particulate matter comprises lead, the method further comprising the step of emitting less than 1.2 $\mu g/m^3$ of lead into the surrounding atmosphere.

9. A method as defined in claim 6, wherein the electrochemical electrode is an anode.

10. An electrochemical electrode comprising an electrode sheet having a sanded surface, wherein the sanded surface comprises grooves formed along the surface of the electrode, and wherein the electrode sheet comprises lead.

11. An electrochemical electrode as defined in claim 10, wherein the electrochemical electrode is an anode for use in electrowinning.

12. An electrochemical electrode comprising an electrode sheet having a sanded surface, wherein the electrode is manufactured using a method comprising the steps of:

(a) providing the electrode sheet;

(b) sanding a surface of the electrode sheet using a sanding mechanism;

(c) emitting a hazardous particulate matter in response to the sanding;

(d) injecting liquid into a region whereby the sanding mechanism and the surface of the electrode come into contact; and (e) containing at least a portion of the hazardous particulate matter using the liquid;

wherein the sanded surface comprises grooves formed along the surface of the electrode; and wherein the electrode sheet comprises lead.

13. A method of using an electrochemical electrode, the method comprising the steps of (a) providing the electrode, wherein the electrode was manufactured by a method comprising the steps of:

(i) providing an electrode sheet comprising lead;

(ii) sanding a surface of the electrode sheet using a sanding mechanism;

(iii) emitting a hazardous particulate matter in response to the sanding;

(iv) injecting liquid into a region whereby the sanding mechanism and the surface of the electrode come into contact; and (v) containing at least a portion of the hazardous particulate matter using the liquid; and (b) using the electrode in an electrochemical operation.

14. A method as defined in claim 13, wherein the hazardous particulate matter comprises lead, and step (iii) further comprises the step of emitting less than 1.2 $\mu g/m^3$ of lead into a surrounding atmosphere.

15. A method as defined in claim 13, wherein step (ii) comprises the steps of:

moving the electrode sheet into the sanding mechanism using a conveyor belt, the conveyor moving at 5-10 feet per minute; and applying a sanding head to the surface of the electrode sheet, the sanding head having a 36 grit rating.

16. A method as defined in claim 15, wherein step (ii) further comprises the step of applying a 65-70 head load percentage to the sanding head.

17. A method as defined in claim 13, wherein the electrode is an anode for use in electrowinning.

18. A method of using an electrochemical electrode, the method comprising the steps of:

(a) providing the electrode, the electrode comprising an electrode sheet having at least one sanded surface wherein the sanded surface comprises grooves formed along the surface of the electrode, and wherein the electrode sheet comprises lead; and (b) using the electrode in an electrochemical operation.

19. A method as defined in claim 18, wherein the electrochemical operation is electrowinning.

20. A method as defined in claim 18, wherein the electrode is an anode.

* * * * *